US005676212A

United States Patent [19]

Kuckes

[11] Patent Number: 5,676,212

[45] Date of Patent: Oct. 14, 1997

[54] DOWNHOLE ELECTRODE FOR WELL GUIDANCE SYSTEM

[75] Inventor: Arthur F. Kuckes, Ithaca, N.Y.

[73] Assignee: Vector Magnetics, Inc., Ithaca, N.Y.

[21] Appl. No.: 634,905

[22] Filed: Apr. 17, 1996

[51] Int. Cl.[6] ..... E21B 7/04

[52] U.S. Cl. ..... 175/45; 175/50; 166/66.5

[58] Field of Search ..... 175/45, 61, 50, 175/40; 166/65.1, 66.5

[56] References Cited

U.S. PATENT DOCUMENTS

| | | | |
|---|---|---|---|
| 4,372,398 | 2/1983 | Kuckes . | |
| 4,529,939 | 7/1985 | Kuckes . | |
| 4,593,770 | 6/1986 | Hoehn, Jr. . | |
| 4,700,142 | 10/1987 | Kuckes . | |
| 4,791,373 | 12/1988 | Kuckes . | |
| 4,845,434 | 7/1989 | Kuckes et al. . | |
| 4,933,640 | 6/1990 | Kuckes . | |
| 5,074,365 | 12/1991 | Kuckes . | |
| 5,103,920 | 4/1992 | Patton | 175/45 |
| 5,163,521 | 11/1992 | Pustanyk et al. | 175/40 |
| 5,218,301 | 6/1993 | Kuckes . | |
| 5,230,387 | 7/1993 | Waters et al. | 175/45 |
| 5,305,212 | 4/1994 | Kuckes . | |
| 5,343,152 | 8/1994 | Kuckes . | |
| 5,419,405 | 5/1995 | Patton | 175/45 X |
| 5,485,089 | 1/1996 | Kuckes | 175/45 X |
| 5,512,830 | 4/1996 | Kuckes . | |
| 5,513,710 | 5/1996 | Kuckes . | |
| 5,515,931 | 5/1996 | Kuckes . | |

*Primary Examiner*—Frank Tsay
*Attorney, Agent, or Firm*—Jones, Tullar & Cooper, P.C.

[57] ABSTRACT

A borehole guidance system for guiding a well being drilled with respect to an existing reference well includes a multi-sectioned casing in the reference well. A selected section of the casing, usually the lowest section, is electrically conductive and the next adjacent section is electrically nonconductive. A wireline connects a current source on the surface to the selected conductive section to produce a reference current in the well. The reference current is injected into the earth and dissipated so that the current produces a reference magnetic field surrounding the well which is unaffected by return currents.

17 Claims, 3 Drawing Sheets

DOWNHOLE ELECTRODE FOR WELL GUIDANCE SYSTEM

BACKGROUND OF THE INVENTION

The present invention relates to a system and technique for controlled drilling of wells, and more particularly to guiding the drilling of wells near, and parallel to, an existing well by magnetic fields generated by current flow in an insulated current-carrying wireline connected to a conductive section of casing at the bottom of the existing well.

The magnetic fields produced by current flow in an existing well are an extremely valuable tool in the guidance of drilling equipment, and a considerable amount of effort has been devoted to the development of techniques for producing such fields and to the development of highly sensitive equipment for accurately detecting them. The detection equipment may be located in a borehole being drilled, for example, to detect the distance and direction to the existing well, which then serves as a reference for controlling the direction of drilling so that the borehole can be positioned with respect to the reference well either to intercept it at a desired location, to avoid it, or to pass near it, as may be desired.

Such directional control systems may be used in drilling a new well in a field of existing wells where the existing wells are to be avoided, in drilling a rescue well to intersect an existing well which has blown out, in drilling horizontal collection boreholes adjacent existing wells, and in numerous other applications. For example, a producing oil field typically includes a large number of wells leading generally vertically from the surface of the earth downwardly into oil-bearing strata from which crude oil is extracted. These wells often are quite close together, particularly when the wells originate at an offshore drilling platform and, as pointed out in U.S. Pat. No. 4,593,770 to Hoehn, the drilling of additional vertical wells within such a field requires careful control of the drilling in order to avoid intersection with existing wells. In accordance with the Hoehn patent, such undesired intersections are avoided by lowering, as by means of a support cable, a wireline carrying a bore hole tool into each of the existing wells and injecting into the casings of such existing wells, at selected depths, alternating currents which produce corresponding magnetic fields surrounding the existing well casings. The bore hole tool carries contact pads which incorporate electrodes for contacting the casing of the well in which the bore hole tool is located, so that current can flow downhole through the support cable and through the electrodes into the casing. In the Hoehn patent, each of the existing wells is injected with current of a different frequency so that specific wells can be identified by the frequency of their corresponding magnetic fields. A magnetometer in a non-magnetic section of a well being drilled can then measure the magnetic fields produced by current flow in the existing wells during drilling so that the well being drilled can be redirected as required. By the technique described in the '770 patent, a large number of wells can be drilled into an oil bearing field so as to maximize its production.

As a further example, when the oil contained in an oil-bearing field is gradually depleted by operating producer wells, the flow of oil to the wells gradually slows, and eventually stops. Often, however, there remains a considerable amount of oil in the strata from which the oil is being drawn, even though the wells have stopped producing. This remaining oil can be recovered by means of a "rescue" well which is drilled from the surface downwardly to the oil bearing strata. Such a rescue well is, in many cases, drilled vertically near one or more existing vertical producer wells and then must curve horizontally through the well field, without intersecting the existing producer wells. The horizontal run of the rescue well is guided not only to avoid intersection with the producer wells, but also to pass within about two meters of a selected reference vertical producer well. The horizontal well passes the reference producer and travels beyond it a predetermined distance, and is then sealed at its far end. The horizontal run is then perforated by a multiplicity of holes spaced along its length from its far, or terminal, end toward a near location which is a distance on the near side of the reference vertical producer well approximately equal to the distance of the far end from the producer well. After perforation, the horizontal section is sealed off at the near location to form a closed near end. This leaves a sealed-off, perforated, intermediate section which forms a right angle, or T, with respect to the reference vertical producer well. This perforated section preferably is symmetrical with respect to the reference well, and serves to collect oil from the oil bearing strata in the region of the reference vertical producer well and to drain that collected oil toward the producer well.

When a system of collectors is to be provided, the rescue well is redrilled above the near-end plug and is again directed horizontally toward a second reference producer well in the field. The horizontal rescue well is again drilled to pass near, but to avoid a direct intersection with, the second reference vertical producer well and extends past that vertical well by a selected distance. The rescue well is again sealed at its far end, is perforated, and is sealed at a near location which is equidistant from the reference vertical well to form a near end, thereby producing a second field-draining intermediate collector section which directs oil to the second producer well. The rescue well may again be redrilled from the region of the near-end plug and the process repeated for a third and for subsequent vertical producer wells.

Numerous other applications of borehole drilling techniques which require accurate control of the drilling of a borehole, or rescue well, through a field of existing, or reference, wells are known. In each it is critical to the success of the technique that reliable information about the relative locations of the rescue and reference wells be available at the earliest possible time during the drilling.

A convenient directional control system for situations where the target wells are open; i.e., where access to the wells is available from the surface, is illustrated in the above-mentioned U.S. Pat. No. 4,593,770. In accordance with that patent, the depth within each existing well at which current is injected is at a point that is as close as possible to the likely intersection point between the existing well and the well being drilled. Current then flows from the point of injection both upwardly and downwardly in the casing to produce a resultant magnetic field in the earth surrounding the existing well and the well being drilled. Thus, the current flowing down the wireline produces a first magnetic field around the well. The current divides after it is injected into the casing, with one half of the current flowing downwardly from the injection point, and one half flowing upwardly from that point toward the surface. Since the upward current in the casing is one-half the current in the wireline, a second magnetic field produced by the upwardly flowing current in the casing surrounding the wireline is equal to one-half of the first magnetic field produced by the downwardly flowing wireline current. The second magnetic field is in direct opposition to the first magnetic field so that the net magnetic field above the injection point, which is the difference between the first and second fields, is equal to one half the magnetic field produced by the wireline current. The magnetic field below the injection point is also reduced by one half that of the wireline current, since only one half of the available current flows downwardly in the casing from that point. Accordingly, using this technique, only one half of the potentially available wireline magnetic field is actually available for use in guiding the well being drilled.

In U.S. Pat. No. 5,074,365 to Arthur F. Kuckes, accurate and reliable well drilling control information is provided by detecting, at a well being drilled, an alternating magnetic field produced by current flow in a target (or reference) vertical well. This reference alternating magnetic field is produced by lowering an insulated wireline conductor to the bottom of the selected target producer well. An electrode at the end of the wireline provides electrical contact with the bottom of the well. If the target well is cased, contact is preferably made with the casing at the bottom of the casing; if it is uncased, then contact is made with the earth at the bottom of the well, or at a relatively large distance below the anticipated point of intersection of the well being drilled with the existing well. Alternating current is applied between the wireline and the earth at the surface, whereby current flows down the wireline and through the electrode contact to the bottom of the casing or into the earth. A negligible amount of the current supplied by the wireline flows downwardly out of the bottom of the casing into the surrounding earth and is dissipated, but this current is so small it can be ignored. The remaining current flows upwardly from the electrode, initially through the casing in a cased well. The current produced in the casing is gradually dissipated into the surrounding earth, with the upward current flow in the casing falling off exponentially with the distance Z along the axis of the reference well from the injection point at $Z_0$, where the electrode contacts the casing.

At a point $Z_1$, above the injection point, the current in the casing or in the earth near the well will have dropped to about 37% of the maximum value at the electrode point $Z_0$. The difference between the current which flows downwardly through the wireline and that which flows upwardly through the casing or the nearby surrounding earth produces, at any point along the target well, a net, symmetrical magnetic field in a plane perpendicular to the axis of the target well. When the reference well is vertical, the surrounding magnetic field will be horizontal, and will surround the axis of the well. The net magnetic field above the location of point $Z_1$, where the counter-flowing current in the casing or in the earth near the well is minimized, is primarily due to current flow in the wireline. In this region, therefore, the wireline current is the primary source of the magnetic field used in guiding any well being drilled near the reference well.

In accordance with the '365 patent, the net magnetic field produced by the AC current flow in the target well may be detected in the well being drilled by means of orthogonal fluxgate magnetometers which produce output vector signals from which the direction to the source of the magnetic field can be determined. Such magnetometers are also described in U.S. Pat. No. 4,791,373 issued to the applicant herein. In that patent, however, the current flow is produced by means of an electrode located in the relief well rather than in the target well. The electrode injects current into the earth surrounding the relief well, and a portion of that current is collected in the reference well casing to produce around the casing a resulting magnetic field which is detectable by a magnetometer also located in the relief well. Such a method is extremely valuable in situations where there is no access to the reference well, but has limitations in well avoidance drilling in an environment where there are multiple cased wells. This is because a ground-injected current tends to collect in the casings of all of the surrounding wells, thereby producing multiple magnetic fields which make the directional drilling of the rescue well very difficult.

SUMMARY OF THE INVENTION

In accordance with the present invention, a well guidance, or reference, magnetic field is produced by a reference current in a wireline located in a cased reference well. This magnetic field is produced in the earth surrounding the well, and the wireline is located and connected in such a way as to maximize this field. This is accomplished by connecting the surface end of the wireline to one terminal of a source of current, such as a reversible direct current, and connecting the bottom of the wireline to an electrode which causes the current which flows in the wireline to be injected into the earth at the bottom of the reference well. The injected current is dissipated in the earth in such a way that return current to the source on the surface is inhibited from flowing in the reference well casing, and thus does not produce any significant reduction of the magnetic field produced by the wireline current.

The reference magnetic field produced by the wireline current may be measured by a magnetic field sensor assembly located in a nearby well being drilled for use in guiding the drilling of that well. This sensor assembly utilizes, for example, a measurement while drilling (MWD) orientation instrument such as that described in U.S. Pat. No. 5,485,089 of Arthur F. Kuckes, the disclosure of which is hereby incorporated herein by reference. Such an MWD instrument utilizes fluxgate magnetometers for measuring the apparent earth's magnetic field and may also include accelerometers for measuring the earth's gravity and, if desired, may include gyroscopes for measurement of the orientation of the drilling equipment. Such an instrument is also described, for example, in U.S. Pat. No. 4,700,142 of Arthur F. Kuckes, the disclosure of which is hereby incorporated herein by reference.

As is known, a conventional borehole casing consists of a multiplicity of 10-meter long sections, usually of steel, secured in end to end relationship as the casing is lowered into the borehole. Usually the sections are threaded together, but other fastenings may be utilized. In accordance with the present invention, to ensure injection of the wireline target current into the earth at the bottom of the borehole, the penultimate section of the casing is constructed of an electrically insulating material, with the remainder of the casing being electrically conductive. Thus, the lowermost section may be of steel, the section next above the lowermost section may be of fiber glass or other insulating material, and the remaining sections of casing may be of steel. If desired, additional sections at spaced locations along the casing may also be of insulating material.

The wireline, which preferably is a conventional insulated armored cable, has a section of its insulation removed from its end to expose the bare wire of the cable. To provide a target current in the existing well, the cable is lowered into the target well through the interior of the casing until the bare end of the cable is in the lowermost conductive casing section. When the end of the cable reaches the bottom of the well, the lowering of additional cable causes the bare wire to begin to fold and to coil, thereby bringing the bare cable into mechanical and electrical contact with the interior surface of the lowermost steel casing section so that this section becomes an electrode for the cable. Since this electrode is in contact with the earth surrounding the borehole, current from the wireline will flow into the electrode and be injected into the earth from the electrode. The presence of the electrically insulating fiberglass section immediately above the electrode section inhibits current from flowing upwardly from the electrode into the upper part of the casing, thereby forcing all of the current into the earth at the bottom of the well.

One terminal of a surface current source such as a reversible D.C. source is connected to the cable at the surface of the earth. A second current source terminal forms the ground side of the current source and is connected to earth at a large distance from the head of the borehole in which the wireline is located. This surface ground point provides a return path for current injected into the earth from the electrode at the bottom of the casing. By spacing the ground point away from the reference well, the return path to this ground point from the electrode prevents significant return current flow near the reference well or in the region of the borehole being drilled near the reference borehole. As a result, magnetic fields produced by these return ground currents do not significantly interfere with the magnetic field produced by current flow in the wireline, thereby maximizing the reference guidance field to increase the distance at which measurements can be made and to improve the accuracy of such measurements.

If the reference well is essentially vertical, the wireline can be simply dropped into the well to provide the needed connection with the bottom electrode, as discussed above. However, if the reference well has a horizontal component, so that the wireline cannot simply be dropped into the casing, the wireline may be carried by a tubing string which extends down through the casing. The tubing string receives the lower end of the cable and as the tubing is inserted through the casing the lower end of the wireline is carried into contact with the electrode section. A further alternative is to position the tubing string in the casing and to then pump the wireline through the tubing by means of drilling mud, for example, the mud carrying the end of the wireline downwardly to contact the electrode section. Still another alternative is to utilize drilling mud within the casing to carry the cable into position.

In a preferred form of the invention, a positive contact between the end of the wireline and the casing section which is to serve as the current-injecting electrode is provided by a stabber/receiver assembly. Such an assembly includes, for example, a receiver in the casing which is of reduced diameter, and which is electrically connected to the tubular well casing. The end of the cable carries, for example, a pair of spring arms which are compressed to allow the cable to travel through a guide tube and which expand to engage the receiver. The spring arms are connected to the cable conductor, and contact the receiver to provide the required electrical connector between the cable and the electrode.

Once the cable is in place, a low frequency current, such as a reversible direct current of, for example, 5 to 10 amperes, is applied by the surface current source to the cable. This current flows through the cable to the electrode, where it is injected into the earth to produce a magnetic field surrounding the wireline. As noted above, this field is detected by an MWD instrument located in a nearby well being drilled, and is used as a reference to guide its drilling. Such adjacent wells may be drilled, for example, along a path parallel to the reference well and within about 5 meters of that well, with an accuracy of plus or minus 2 meters, over the entire length of the reference well. The MWD instrumentation provides vector signals which provide a measure of the direction and distance of the reference well wireline from the drill during drilling of the parallel well. Simultaneous measurements are made of the orientation of the sensor within the borehole being drilled, and a continuous calculation of the presumed location of the reference well with respect to the location of the well being drilled is made. This calculated information is used to guide further drilling of the well.

BRIEF DESCRIPTION OF THE DRAWINGS

The foregoing, and additional objects, features and advantages of the present invention will become apparent to those of skill in the art from the following detailed consideration thereof, taken in conjunction with the accompanying drawings, in which.

DESCRIPTION OF THE PREFERRED EMBODIMENTS

Figure 1:
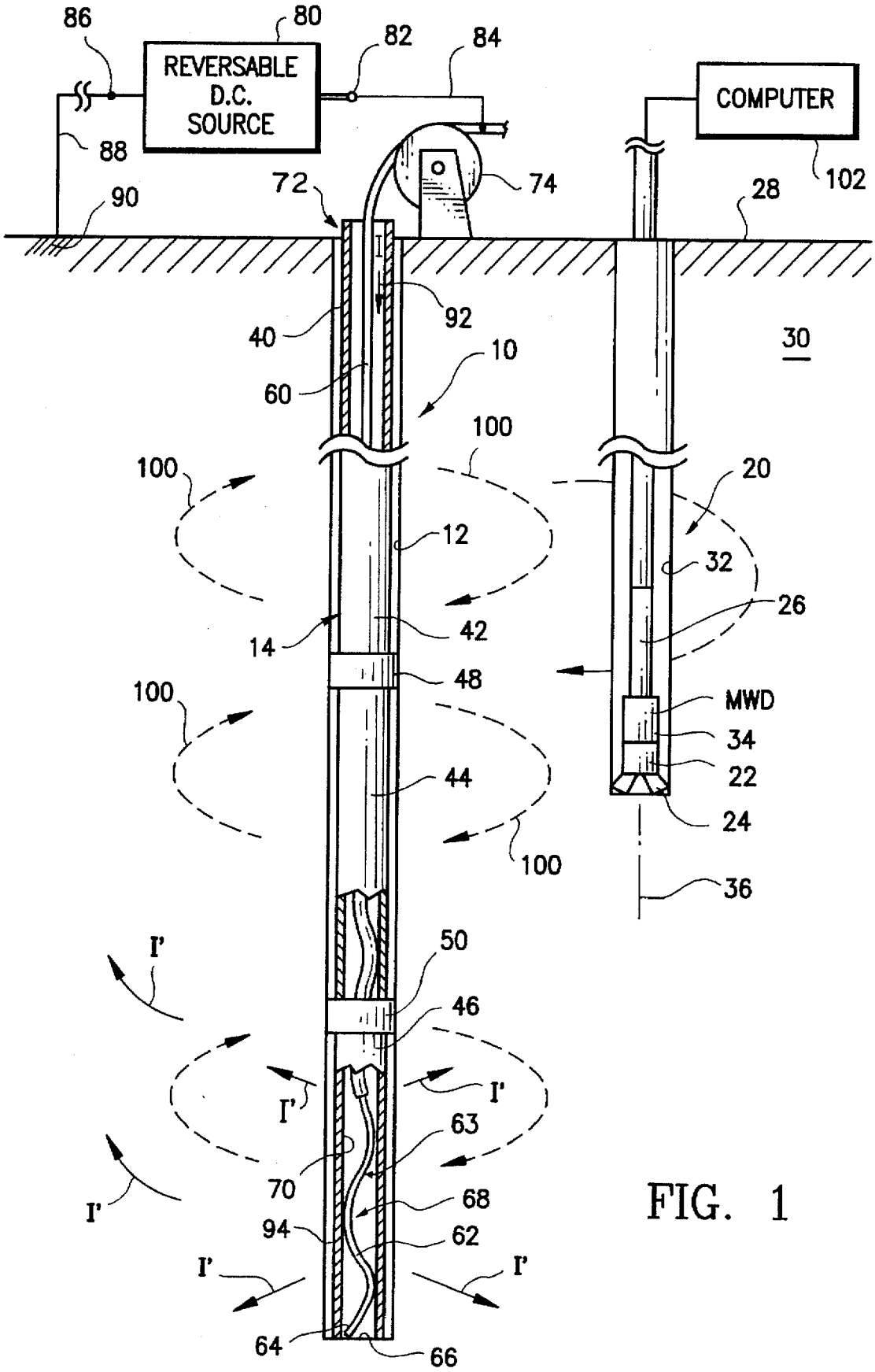
FIG. 1 is a diagrammatic cross-sectional view of a cased vertical reference well and an adjacent well being drilled, with the reference well containing a wireline in accordance with a preferred form of the invention.

Turning now to a more detailed consideration of the present invention, there is illustrated in FIG. 1 an existing reference well 10 which incorporates a borehole 12 containing a casing 14. The existing well may be a producer well or any other type of well which is to be tracked by a well being drilled, for example, a guided well such as that generally indicated at 20 in FIG. 1. The guided well may be a relief well which is to intersect the existing well, which is to avoid the existing well, or which is to be drilled along a path parallel to the existing well, for example. For purposes of illustration, it will be assumed for the embodiment of FIG. 1 that the well 20 being drilled is to follow a path that is generally parallel to well 10, and which is approximately 5 meters away from the existing well.

The guided well 20 may incorporate a drill head 22 carrying a rotary bit, for example, as illustrated at 24, with the drill head being carried at the lower end of a conventional drill string 26. The drill is operated from suitable surface equipment (not shown) located at the surface 28 of the earth 30 to drive the bit 24 to form borehole 32. The drill head 22 is steerable to control the direction of drilling, and the drill string carries suitable measurement while drilling (MWD) instrumentation 34. The MWD instrumentation preferably incorporates three orthogonally related fluxgate magnetometers for measuring the x, y and z vectors of magnetic fields in the earth in the region of the drill head 22 with respect to the axis 36 of the drill head. The MWD instrumentation may also include accelerometers for measuring the earth's gravitational field and, if desired, may include gyroscopes for measuring the rotational position of the instrumentation within borehole 32.

The casing 14 in the existing target well 10 preferably is a conventional electrically conductive steel casing incorporating a multiplicity of sections such as those illustrated at 40, 42, 44, and 46. Conventionally, such sections are each about 10 meters long and are connected end to end by suitable threaded joints such as those diagrammatically illustrated at 48 and 50. The casing structure is conventional, as are the joints or other fasteners used to secure them in end to end relationship. An exception to this is the penultimate casing section 44, which is next above the lowermost, or distal, end section 46. This penultimate section 44 is fabricated from an electrically nonconductive, or insulating, material such as fiberglass so as to break the electrical continuity of the casing and to separate the conductive casing section 46 from the conductive casing section 42. The nonconductive section 44 preferably is also 10 meters in length to ensure that little current leaks from end section 46 to the remainder of the casing. Other lengths may be used, if desired, and additional sections may be used as required to inhibit return currents from flowing in the casing.

In accordance with the present invention, a wireline 60 is positioned in the interior of casing 14, extending along the hollow interior of the entire length of the borehole 12. The wireline 60 consists of a conventional insulated and armored cable having an interior electrical conductor 62 which, in accordance with the invention, is exposed at the lowermost end of the cable as generally illustrated at 63. For example, the covering insulation may be removed from approximately the endmost 10 meters of the armored cable so that when the wireline is completely inserted into the casing the conductor 62 will be located within the interior of casing section 46. In a vertical target well, the wireline may be dropped down into the casing so that the tip 64 of the conductor 62 reaches the bottom 66 of the borehole 12. By feeding an additional length of the wireline 60 into the casing, the conductor 62 folds and coils on itself, as generally illustrated at 68, so that the bare portion 63 of the conductor 62 engages the inner surface 70 of the electrically conductive casing section 46. Preferably, the conductor contacts the casing section 46 at several locations, so as to produce a good electrical contact between the conductor and this casing section.

At the surface 28, the wireline may be fed into the interior of the casing at the well head 72 by suitable equipment such as a feed wheel 74. Also at the surface, a current source 80, such as a reversible DC source, has a first terminal 82 connected by way of wire 84 to the inner conductor 62 of wireline 60 to supply direct current to conductor 62. The source 80 includes a second terminal 86 which is connected by way of a wire 88 to a suitable ground return point 90 at the earth, with the ground point 90 preferably being spaced away from the well head 72 by several hundred feet, or more.

The current source 80 supplies to the wireline 60 a current I, indicated by the arrow 92, which current flows down the wireline between the source and the casing section 46, and through the contact between the bare conductor 62 and the inner surface 70 of the casing to the casing. The outer surface 94 of the casing section 46 is in contact with the earth at the bottom of borehole 12 so that the current I is injected into the earth, as indicated by the arrows I'. The current I' cannot travel up the casing toward the surface because of insulating section 44, but is forced out into the earth to dissipate and eventually return to the source 80 by way of ground connection 90.

As a result of the foregoing connections, the dominant current in the well 10 above the penultimate section 44 is the current I flowing through the wireline 60. This current produces a magnetic field indicated by lines 100 surrounding and coaxial with the well 10 and in a plane perpendicular to the axis of the well. This magnetic field extends outwardly from the well 10 and is sensed by the MWD instrumentation 34 in well 20. The magnitude and direction of the x, y and z vectors of this magnetic field 100 are measured by the instrumentation and are transmitted up hole to the surface 28 where a computer 102 connected to the instrumentation 34 calculates the distance and direction from the drill head 22 to the reference well 10. Because the only current flowing in well 10 other than leakage currents is the wireline current I, the magnetic field 100 is at its maximum value and is not diminished by the dissipated return currents I'. Accordingly, the distance and direction measurements are substantially unaffected by the return currents and are thus more accurate than has been possible with prior target current sources.

Figure 2:
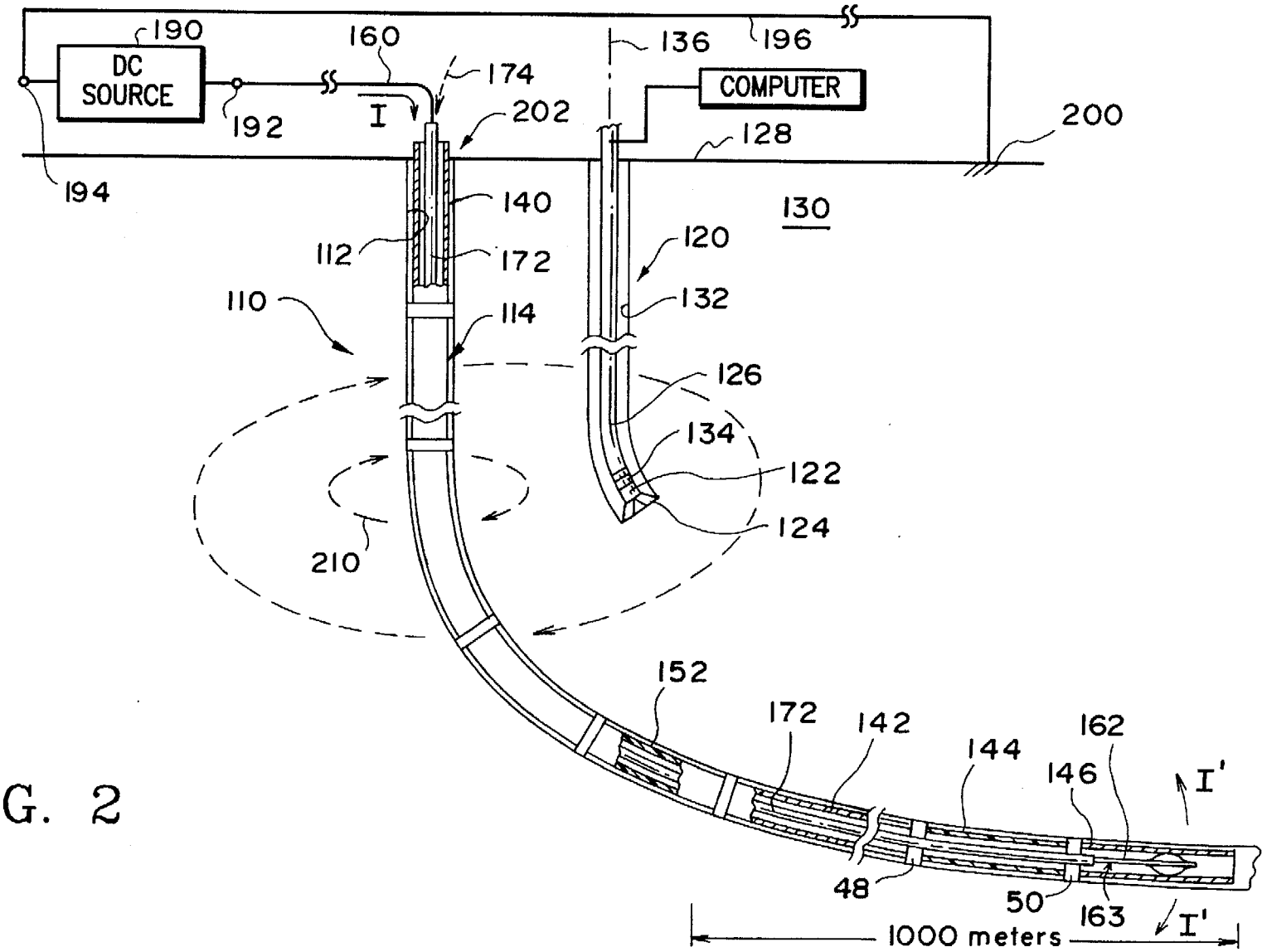
FIG. 2 is a diagrammatic cross-sectional view of a cased horizontal reference well and an adjacent well being drilled, with a wireline placed in the target well by a tubing within the target well casing.

The principles illustrated in the embodiment of FIG. 1 are also applicable to drilling boreholes with respect to existing wells having not only vertical components such as the well 10 in FIG. 1, but having horizontal components such as the curved well 110 illustrated in FIG. 2. Well 110 incorporates a borehole 112 containing a casing 114 which is normally electrically conductive in the manner described above. A guided well 120 being drilled near the well 110 includes a drill head 122 carrying a rotary bit 124 supported on a drill string 126. The drill string is operated from the surface 128 of the earth 130 to produce a borehole 132. The drill string carries MWD instrumentation 134 to measure the x, y and z vectors of the earth's apparent magnetic field in the region of the drill head with respect to the axis 136 of the borehole, as described with respect to FIG. 1.

The casing 114 in target well 110 incorporates a multiplicity of casing sections such as those illustrated at 140, 142, 144 and 146, with the adjacent sections being secured together end-to-end as by threaded joints 14, 150, etc. as previously described. The sections of the casing between the topmost section 140 and a lower section 142 may be conventional 10 meter long steel sections which are electrically conductive, as is the lowermost section 146. However, the penultimate section 144 is of an electrically nonconductive or insulating material such as fiberglass, as previously described. If desired, additional sections, such as sections 152, may also be of an insulating material if desired, and such sections may be spaced along the drill string 114 to further inhibit return currents on the casing. A wireline 160 consisting of an armored, insulated cable having an inner conductor 162 is fed through the center of casing 114. The endmost portion of the wireline is stripped of its insulation to expose the inner conductor, as illustrated at 163 in FIG. 2. The wireline 160 is fed sufficiently far into the casing to cause the bare conductor 162 to extend into the casing section 146 so that this section acts as a current electrode in contact with the earth, as previously described with respect to casing section 46 in FIG. 1.

Because of the curvature of the well 110, positioning of wireline 160 in the casing to provide contact at the lowermost casing section 146 may be difficult. However, this difficulty may be overcome in accordance with the embodiment of FIGS. 2 and 3 by locating the wireline 160 within a tubing string 172 and inserting the tubing through the casing. The tubing 172 is a thin, flexible pipe which may be about 2⅞ inches in diameter, for example, for insertion into a casing which is 7 inches in diameter. Tubing 170 is electrically insulated from the conductor 160 by the wireline insulation, but if desired it may be of fiberglass or like insulating material. The tubing is inserted down the casing 114 and carries the wireline 160 to position the bare end section 162 in contact with casing section 146.

The wireline preferably is inserted in the tubing before the tubing is placed in the casing; however, this may be impractical in some situations. Therefore, as an alternative, the tubing 172 may be placed in the casing and the wireline 160 then fed through the tubing with, for example, the assistance of drilling mud, indicated by dotted arrow 174, which is pumped down through the interior of the tubing to carry the wireline to the bottom of the casing. The wireline may carry one or more flanges 176 which extend across the diameter of the tubing to enable the drilling mud to carry the wireline into position. The drilling mud may return to the surface through the casing around the outside of the tubing, if desired. As a still further alternative, the tubing may be omitted and the wireline 160 may simply be carried into position by drilling mud 174 flowing down through the interior of the casing.

Figure 3:
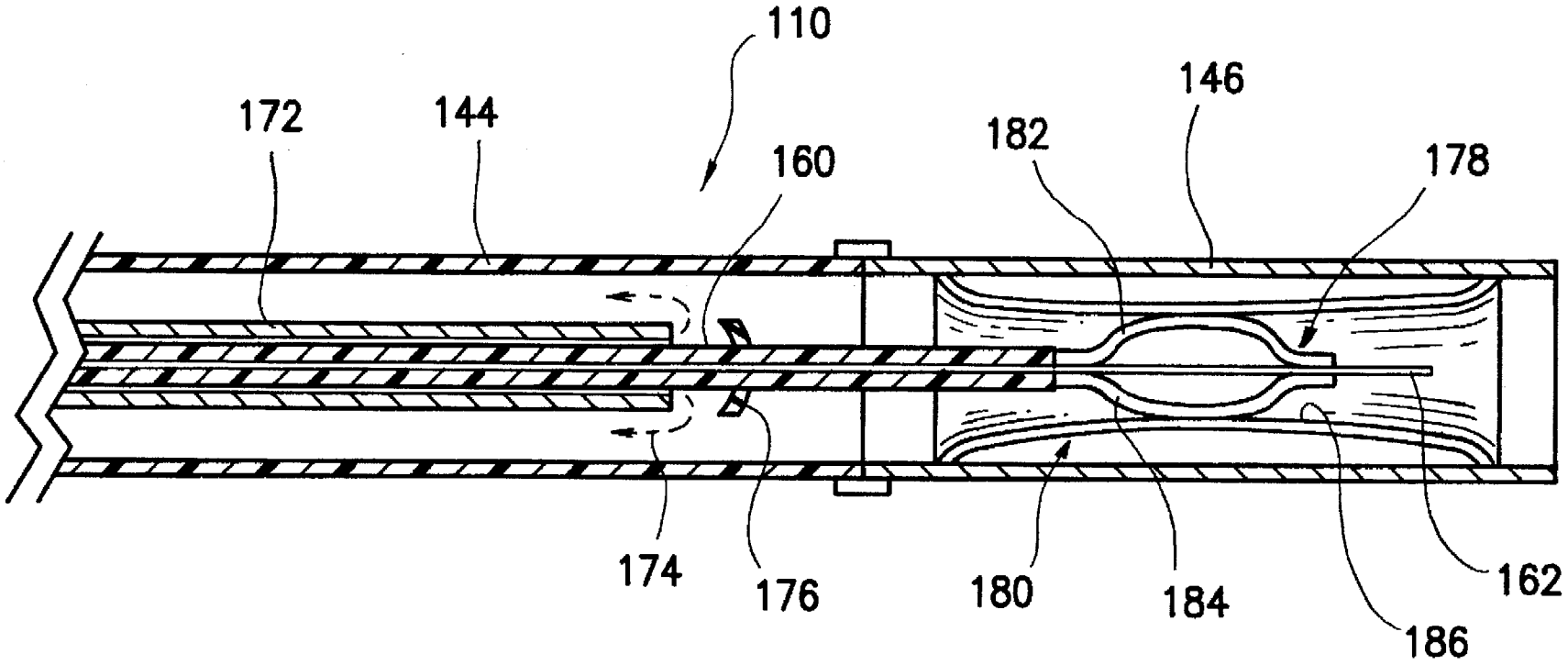
FIG. 3 is an enlarged diagrammatic view of an end portion of the reference well of FIG. 3.

To provide a positive electrical connection between the conductor 162 of wireline 160 and the section 146 of the casing which is to serve as the ground-contact electrode, the wire is provided with a "stabber" generally indicated at 178, and the section 146 carries a "receiver" 180. The stabber includes two or more bowed spring arms 182, 184 which are electrically connected to conductor 162. These spring arms may be collapsible to fit through the center of tube 172 when the wireline is pumped through the tube. When the end of the wireline leaves tube 172, the spring arms expand, as illustrated in FIGS. 2 and 3, to engage the electrode 146. In the preferred form of the invention, the electrode 146 carries a receiver 180 which may be in the form of a reduced-diameter connector 186 which receives the stabber and its spring arms 182, 184. The spring arms engage the inner surface of connector 186, so that the stabber/receiver assembly provides electrical connection between the wireline conductor 162 and the electrode 146.

It will be understood that the stabber can take a variety of forms, and that the illustrated features are exemplary. Thus, for example, the stabber can be a separate assembly connected to the end of the wireline and performing the function of flange 176 as well a securing spring armcontacts to the center conductor. It will be understood that the stabber/receiver assembly of FIG. 2 may also be used in conjunction with the vertical well of FIG. 1.

After the conductor 162 of the wireline 160 is in contact with the lowermost casing section 146, the upper end of the wireline may be connected to a reversible direct current source 190 by way of a first terminal 192, with a second terminal 194 of source 190 being connected by way of a wire 196 to a ground point 200 spaced away from well head 202 of reference well 110. As illustrated in FIG. 2, the ground point 202 may be located above the distal end of the curved reference well 110 where the electrode section 146 is located. In this way, current flow I from the D.C. source flows downwardly through well 110 in wireline 160 and is injected into the earth at electrode/casing section 146 and is dissipated in the earth, as indicated by current arrows I'. The return path of the injected current I' to the D.C. source by way of ground point 200 is not along the well 110, with the result that only the current flow in the wireline 160 produces a magnetic field such as that illustrated by the broken lines 210 surrounding and coaxial with the well 110. As previously discussed, this magnetic field 210 is at a maximum value since it is substantially unaffected by the return current flow I', thereby producing maximum sensitivity at the magnetometer via well 120, and improved accuracy in drilling that well. It will be noted that in some circumstances current can leak around the insulating section 144 and enter the upper part of the drill string 14 or 114. However, only a very small quantity of current will do this, less than 10–15% of the injected current, and this will be quickly dissipated. The amount of such current can be calculated within about 20%, leaving a total error of about 3% in the determination of the magnetic field surround the reference well. This is normally an acceptable error, but of greater accuracy is required, additional insulating sections, such as section 152, can be incorporated in the casing to reduce the leakage current.

Preferably, the source 190 is a source of reversible direct current, with the current flow I in both the embodiment of FIG. 1 and the embodiment of FIGS. 2 and 3 preferably in the range of 5–10 amperes. The current flows first in one direction for a period of time and then is reversed to flow in the opposite direction for a second period of time during measurements of the magnetic field. Alternatively, a low frequency (1–5 cps) alternating current may be provided.

Although the stabber/receiver assembly is illustrated as being located at the terminal, or distal, end of the casing, it will be understood that any casing section can be selected to serve as the current injection electrode, with at lest the next adjacent section being insulating to prevent return current flow along the casing.

Although the present invention has been described in terms of preferred embodiments, it will be apparent to those of skill in the art that numerous modifications and variations may be made without departing from the true spirit and scope thereof, as set forth in the accompanying claims.

What is claimed is:

1. A method for providing a reference magnetic field in a cased reference borehole, comprising:

locating a wireline within a sectioned casing in a reference borehole;

producing a current in said wireline said current producing a reference magnetic field in the earth surround the borehole;

injecting said current from said wireline into the earth surrounding the borehole by way of an electrode section of the casing at the bottom of the borehole; and inhibiting said injected current from flowing in casing sections other than said electrode section.

2. The method of claim 1, wherein producing a current includes supplying a reversible direct current to said wireline.

3. The method of claim 2, wherein injecting said current includes electrically connecting said wireline only to said electrode section of the casing.

4. The method of claim 3, wherein inhibiting said current from flowing in casing sections other than said electrode section includes electrically insulating the electrode section from said other casing sections.

5. The method of claim 4, further including providing a return current path located to prevent said current from flowing in the earth adjacent said other casing sections.

6. The method of claim 1, further including dissipating said injected current in the earth to inhibit said injected current from affecting said magnetic field.

7. The method of claim 1, further including:

detecting said reference magnetic field; and guiding the drilling of a second borehole with respect to said reference magnetic field.

8. The method of claim 7, further including providing a remote return current path for injected current to inhibit current from flowing in the earth adjacent to said other casing section and to prevent current from reentering said casing.

9. The method of claim 7, wherein inhibiting current from flowing in casing sections other than said electrode section includes electrically insulating the electrode section from said other casing sections.

10. The method of claim 9, further including providing a positive electrical connection between said wireline and said electrode section.

11. Apparatus for producing a reference magnetic field in a borehole, comprising:

a reference well;

a guided well adjacent said reference well and being drilled along a predetermined path with respect to said reference well;

a casing within said reference well, said casing including multiple adjoined sections with a selected section of said casing being electrically conductive and an adjacent section of said casing being electrically nonconductive;

a wireline in said casing, said wireline including an electrical conductor in electrical contact with said selected section to form an electrode; and a source of current connected to said wireline to produce a reference current in said wireline between said source and said electrode, said electrode being in electrical contact with the earth to inject said reference current into the earth.

12. The apparatus of claim 11, wherein said reference current produces a reference magnetic field surrounding said target well, and further including sensing instrumentation in said guided well and responsive to said magnetic field.

13. The apparatus of claim 12, wherein said sensing instrumentation in said guided well comprises measurement while drilling magnetic field sensors responsive to said magnetic field.

14. The apparatus of claim 13, wherein said source of current is connected between said wireline and a ground point spaced away from said reference well to provide a return path for said injected current at a location remote from said well.

15. The apparatus of claim 11, further including tubing within said casing for positioning said wireline.

16. The apparatus of claim 15, further including means for positioning said wireline within said tubing.

17. The apparatus of claim 16, further including a stabber/receiver assembly interconnecting said conductor and said electrode.

* * * * *